US007647980B2

(12) United States Patent
Corre et al.

(10) Patent No.: US 7,647,980 B2
(45) Date of Patent: Jan. 19, 2010

(54) DRILLSTRING PACKER ASSEMBLY

(75) Inventors: Pierre-Yves Corre, Eu (FR); Vladimir Vaynshteyn, Sugar Land, TX (US); Philippe Hocquet, Vanves (FR); Nicholas Ellson, Houston, TX (US); Alexander F. Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/754,473

(22) Filed: May 29, 2007

(65) Prior Publication Data

US 2008/0053652 A1 Mar. 6, 2008

Related U.S. Application Data

(60) Provisional application No. 60/823,863, filed on Aug. 29, 2006.

(51) Int. Cl.
*E21B 33/12* (2006.01)
*E21B 33/134* (2006.01)

(52) U.S. Cl. ..... 166/387; 166/119; 166/242.7

(58) Field of Classification Search ..... 166/387, 166/119, 242.7, 187, 116, 191
See application file for complete search history.

(56) References Cited

U.S. PATENT DOCUMENTS

| | | | | | |
|---|---|---|---|---|---|
| 2,738,013 | A | * | 3/1956 | Lynes | 277/338 |
| 2,778,432 | A | | 1/1957 | Allen | |
| 2,800,186 | A | * | 7/1957 | Tausch | 166/121 |
| 2,998,721 | A | * | 9/1961 | Gawlik | 73/49.1 |
| 3,552,489 | A | * | 1/1971 | Berryman | 166/120 |
| 3,876,000 | A | * | 4/1975 | Nutter | 166/106 |
| 4,519,456 | A | * | 5/1985 | Cochran | 166/312 |
| 4,838,349 | A | * | 6/1989 | Berzin | 166/187 |
| 4,903,777 | A | * | 2/1990 | Jordan et al. | 166/387 |
| 5,340,626 | A | | 8/1994 | Head | |
| 5,456,322 | A | * | 10/1995 | Tucker et al. | 166/386 |
| 5,579,839 | A | | 12/1996 | Culpepper | |
| 5,702,109 | A | | 12/1997 | Mahin | |
| 5,832,998 | A | * | 11/1998 | Decker et al. | 166/185 |
| 5,833,001 | A | * | 11/1998 | Song et al. | 166/287 |
| 5,839,515 | A | | 11/1998 | Yuan | |
| 5,957,198 | A | * | 9/1999 | Haynes | 166/250.03 |
| 6,102,120 | A | * | 8/2000 | Chen et al. | 166/287 |
| 6,131,662 | A | * | 10/2000 | Ross | 166/369 |

(Continued)

FOREIGN PATENT DOCUMENTS

| | | |
|---|---|---|
| EP | 0890706 | 3/2004 |

(Continued)

OTHER PUBLICATIONS

Super-Tough Carbon-Nanotube Fibers—A.B. Dalton et al., Nature vol. 423, Jun. 12, 2003, p. 703.

*Primary Examiner*—David J Bagnell
*Assistant Examiner*—Cathleen R Hutchins
(74) *Attorney, Agent, or Firm*—Rodney Warfford; David Cate; Jaime Castano

(57) ABSTRACT

A packer assembly for use in wellbore operations includes a first packer and a second packer interconnected by an adjustable length spacer. The spacer provides a mechanism for adjusting the distance between the first packer and the second packer when the assembly is positioned in a wellbore.

7 Claims, 10 Drawing Sheets

U.S. PATENT DOCUMENTS

| | | | | |
|---|---|---|---|---|
| 6,167,963 | B1 | 1/2001 | McMahan et al. | |
| 6,289,994 | B1 | 9/2001 | Willauer | |
| 6,296,054 | B1 | 10/2001 | Kunz | |
| 6,402,120 | B1 | 6/2002 | Swaab | |
| 6,896,049 | B2 * | 5/2005 | Moyes | 166/82.1 |
| 2003/0075342 | A1 | 4/2003 | Gunnarsson | |
| 2003/0098153 | A1 | 5/2003 | Searfin | |
| 2004/0079915 | A1 * | 4/2004 | Contin et al. | 251/167 |
| 2004/0129432 | A1 * | 7/2004 | Wills et al. | 166/387 |
| 2004/0216871 | A1 | 11/2004 | Mendez | |

FOREIGN PATENT DOCUMENTS

| | | | | |
|---|---|---|---|---|
| EP | 1437480 | A1 | | 7/2004 |
| GB | 2099541 | | | 12/1982 |
| GB | 2275066 | | | 8/1994 |
| GB | 2337064 | | | 11/1999 |
| GB | 2355033 | A | | 4/2001 |
| GB | 2355033 | A | * | 11/2001 |
| GB | 2377959 | | | 1/2003 |
| GB | 2377960 | | | 1/2003 |
| GB | 2377961 | | | 1/2003 |
| GB | 2377962 | | | 1/2003 |
| GB | 2382364 | | | 5/2003 |
| WO | 0106087 | | | 1/2001 |
| WO | 2006030012 | | | 3/2006 |
| WO | 2006103630 | | | 10/2006 |

* cited by examiner

DRILLSTRING PACKER ASSEMBLY

RELATED APPLICATIONS

This application claims the benefit of U.S. Provisional Patent Application No. 60/823,863 filed Aug. 29, 2006.

FIELD OF THE INVENTION

The present invention relates in general to wellbore operations and more specifically to a packer assembly.

BACKGROUND

In many wellbore operations it is desired to isolate one portion of the wellbore from another part of the wellbore. Isolation, or separation, within the wellbore is often provided by packers. In some packer applications, such as drillstem testing, it is beneficial to limit the axial load on the set packer.

In various wellbore operations a wellbore tool or assembly comprises at least a pair of spaced apart packers to define a testing zone. In many applications it may be desired to test various zones in the wellbore that have different lengths. In these situations is often necessary to trip in and out of the wellbore to adjust the separation between adjacent packers.

Therefore, it is a desire to provide a packer assembly that addresses unresolved drawbacks in the prior art packer assemblies and wellbore tools.

SUMMARY OF THE INVENTION

In view of the foregoing and other considerations, the present invention relates to wellbore operations.

Accordingly, a packer assembly is provided for conducting wellbore operations. A packer assembly for use in wellbore operations includes a first packer and a second packer interconnected by an adjustable length spacer. The spacer provides a mechanism for adjusting the distance between the first packer and the second packer when the assembly is positioned in a wellbore. The packer assembly may be carried by the drillstring. The packer assembly may be connected to the drillstring by a slip-joint or similar connection to limit the application of additional axial load on the set packers due to changes in the length of the drillstring.

A method of conducting a wellbore operation utilizing the packer assembly of the present invention includes the steps of connecting a packer assembly about a drillstring to form a wellbore tool, the packer assembly having a first and a second packer spaced apart from one another by a spacer member; positioning the wellbore tool in a wellbore; expanding the first packer to engage a wall of the wellbore; actuating the spacer member to separate the first packer from the second packer; expanding the second packer to engage the wall of the wellbore; and conducting a wellbore operation.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
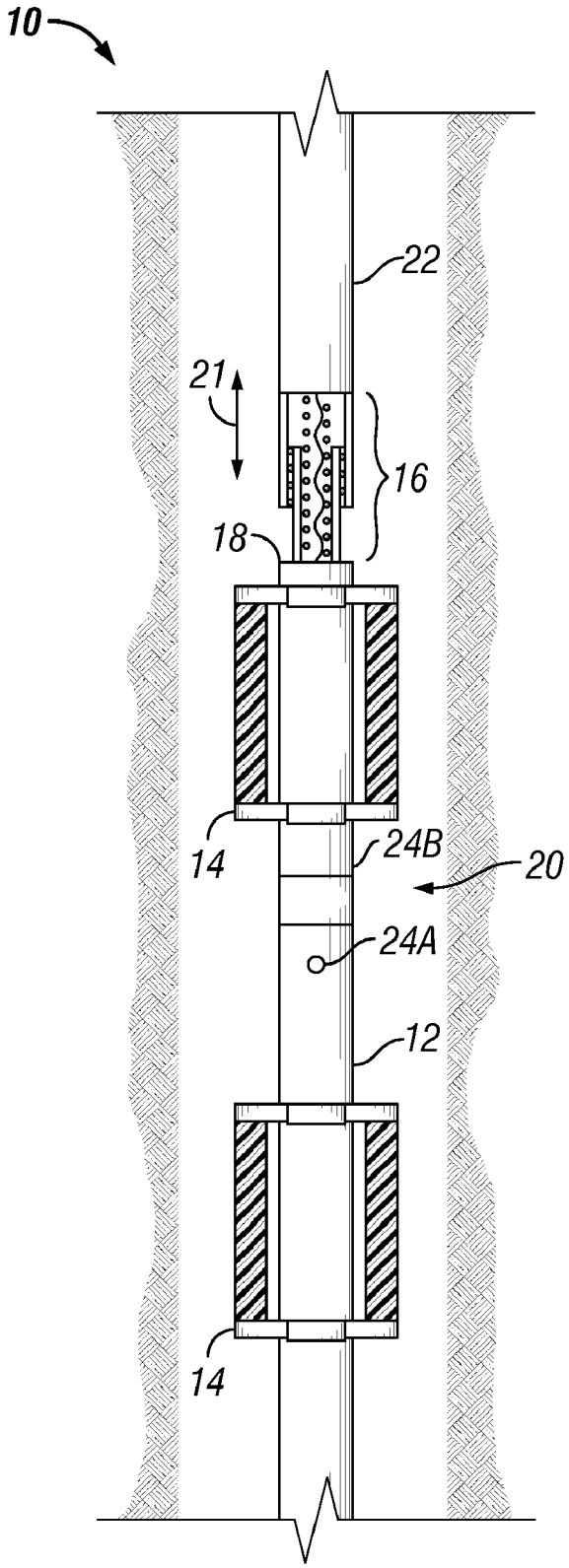
FIG. 1 is an illustration of a packer assembly of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

The present invention provides a wellbore packer assembly that may reduce or eliminate the axial force applied to the set packer by elongation or movement of the drillstring. The present wellbore packer assembly may provide the ability to adjust the spacing between adjacent packers when the assembly is disposed in the wellbore.

The wellbore assembly and method of the present invention is described in relation to drillstem testing (DST) or a mini-DST. However, it should be recognized the packer assembly of the present invention may be utilized for various operations including without limitation, well testing, formation evaluation, and formation stimulation such as fracturing and/or acidizing.

Drillstem testing is typically conducted with the drillstring (drill pipe) still in the borehole. Commonly a downhole shut-in tool allows the well to be opened and closed at the bottom of the hole with a surface actuated valve. One or more pressure gauges are customarily mounted in the DST tool and are read and interpreted after the test is completed. Often the DST tool includes one or more packers to isolate the formation from the annulus between the drillstring and the casing or borehole wall. The DST tool utilized with the present invention may include various mechanisms for testing or determining material characteristics which are referred to herein generally as sensors. The sensors may include, without limitation, sample chambers, pressure gauges, temperature gauges and various types of probes. Various types of sensors may be positioned along the tool of the present invention, such as in a modular design, to provide for multiple testing options during a single trip into the hole.

FIG. 1 is a schematic illustration of an example of a packer assembly of the present invention, generally designated by the numeral 10. Packer assembly 10 of FIG. 1 includes a packer mandrel 12, at least one packer 14, and a slip-joint 16.

Packer assembly 10 includes two spaced apart inflatable packers 14. It is noted that packer assembly 10 may include one, two, or a plurality of packers 14. Examples of inflatable packers include steel cable or slat packers. The inflatable bladder and or outer rubber sleeves can be of suitable materials such as natural rubber, HNBR, nitrile, or FKM.

Mandrel 12 in the embodiment of FIG. 1 is a rigid member providing a spacing 20 between the packers that is determined before the assembly is run into the hole. Mandrel 12 includes testing sensors 24, indicated in FIG. 1 as a pressure gauge 24*a* and a fluid sample chamber 24*b*.

Slip-joint 16 is connected between the top end 18 of packer assembly 10, which in this arrangement is the top of mandrel 12, and drill pipe 22. Electrical wiring 26 and hydraulic lines 28 extend through slip-joint 16 such as for operation of sensors 24.

Slip-joint 16 compensates for axial movement of drillpipe 22, indicated by the arrow 21. Often drillpipe 22 will be secured, such as by the blowout preventer (BOP), during well testing operations to prevent axial pipe movement. However, axial movement or axial lengthening of drillpipe 22 may still occur detrimentally effecting the well testing. For example, packers 14 may be inflated to secure packer assembly 10 within the wellbore and then drillpipe 22 is secured by the BOP to limit the axial movement of drillpipe 22. However, due to thermal expansion of drillpipe 22, an axial load is placed on packer 14. In a conventional packer installation this axial load on the packer may significantly impact the test results, for example by altering the pressure in the test interval during a pressure test. In some instances, the axial load may move the packer relative to the wellbore resulting in damage to the packer, loss of the seal, and mis-identifying the position of the test interval. Thus, slip-joint 16 allows drillpipe 22 to move axially without placing an additional axial load on the actuated and sealingly engaged packers 14.

Figure 2A:
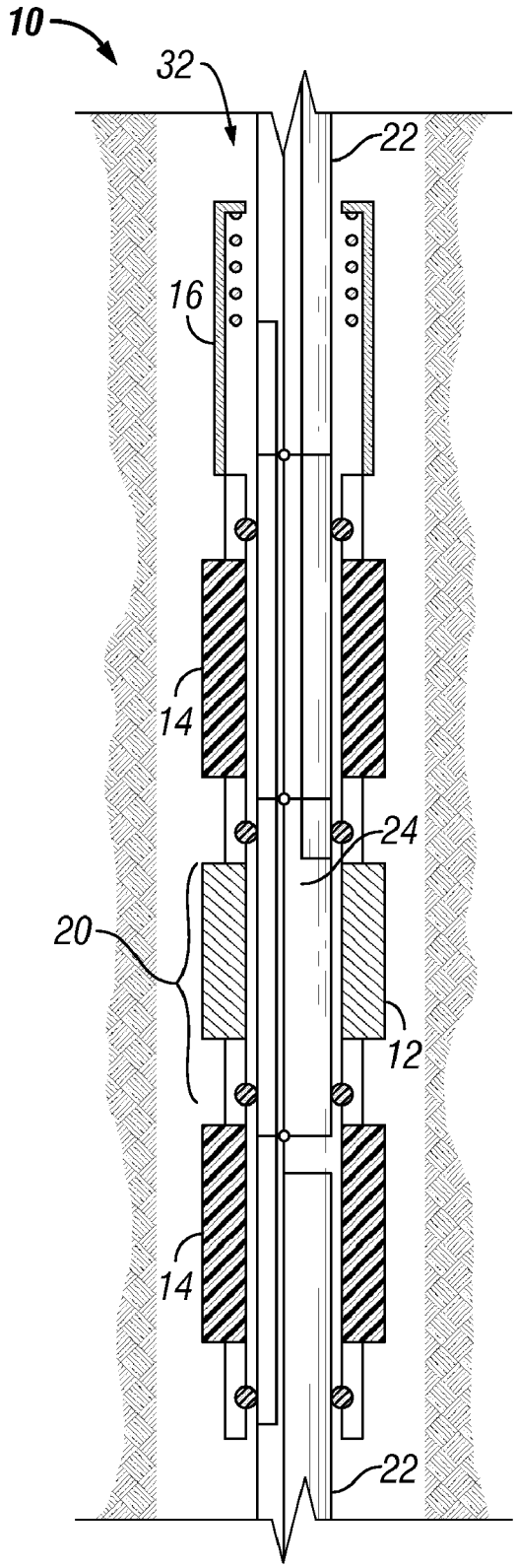
FIGS. 2A and 2B are illustrations of a packer assembly of the present invention utilizing an integral slip-joint.
Figure 2B:
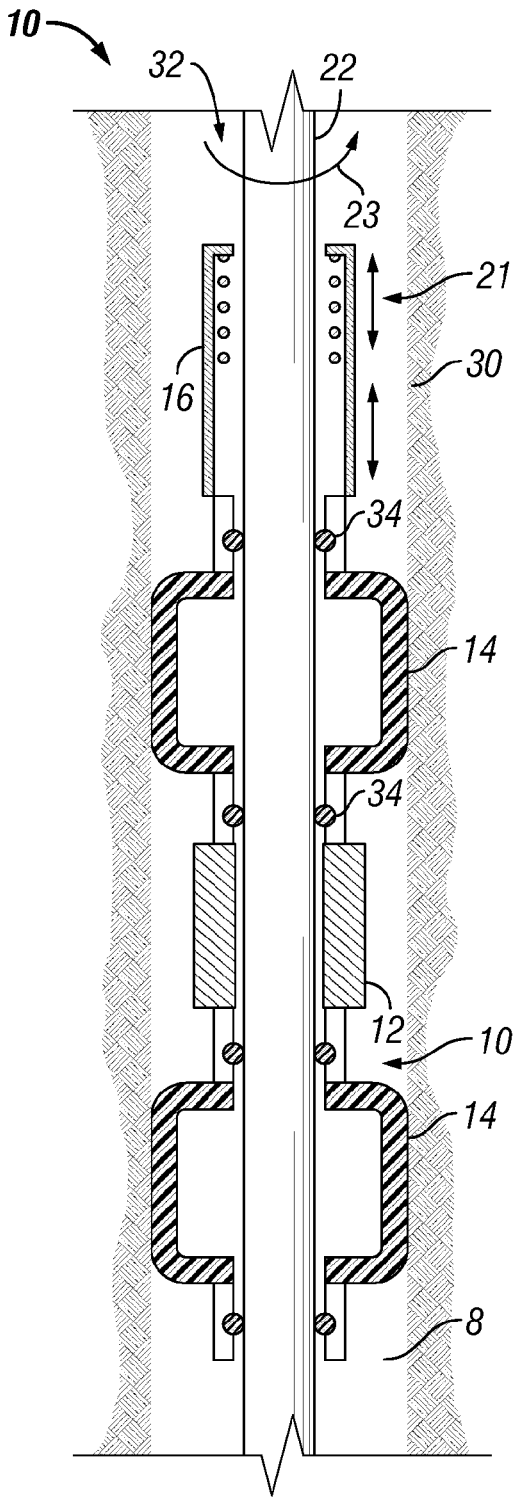

FIGS. 2A and 2B provide illustrations of a dual packer assembly 10 with an integral slip-joint 16. FIG. 2A illustrates assembly 10 in the deflated or unset position. FIG. 2B illustrates assembly 10 in the set or inflated position, wherein packers 14 are actuated to engage and seal against the wellbore wall 30 which may be casing or formation surrounding the borehole.

Packer assembly 10 includes slip-joint 16, a pair of adjacent inflatable packers 14, and a spacing mandrel 12. Slip-joint 16 is connected to the top most packer 14. The adjacent packers 14 are connected to one another and spaced apart by spacing mandrel 12. Mandrel 12 determines and defines space 20 between adjacent packers 14. In the instant example, mandrel 12 is of a fixed length, thus spacing 20 is determined prior to running packer assembly 10 into wellbore 8.

Drillpipe 22 extends through packer assembly 10 and is functionally connected thereto to form a wellbore tool 32. Drillpipe 22 broadly includes various elements suited for the desired tool application, for example stimulation or well testing. For example, in a DST configuration drillpipe 22 may include various modules such as a power cartridge, hydraulic module, fluid sample chambers, and various measuring sensors 24.

Referring to FIG. 2B, packers 14 are expanded to the set position engaging wellbore wall 30. Drillpipe 22 extends through, such as via a stinger mandrel, and is functionally connected to slip-joint 16. Slip-joint 16 compensates for some axial movement 21 of drillpipe 22 relative to packers 14. Thus, the axial load due to axial movement of drillpipe on the engaged packers 14 is limited. In the illustrated embodiment, slip-joint 16 allows for axial movement 21 of drillpipe 22 of approximately 1 meter relative to packer 14. Slip-joint 16 may further allow for rotational movement (arrow 23) of drillpipe 22 relative to packer assembly 10. Fluid seals 34 are positioned between drillpipe 22 and packers 14 to provide hydraulic isolation of packer elements 14.

Figure 3:
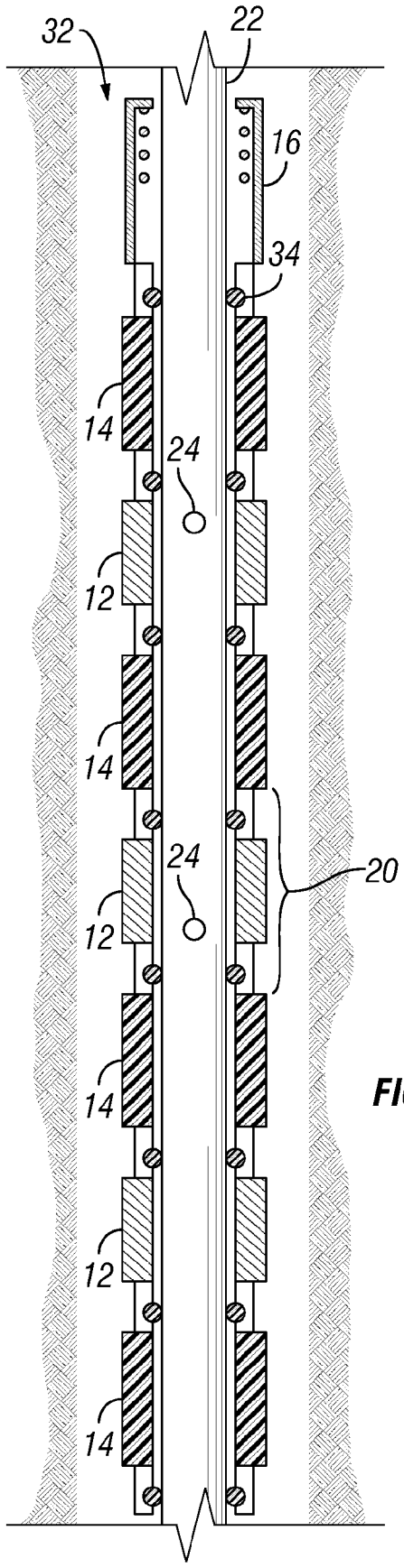
FIG. 3 is an illustration of a packer assembly of the present invention utilizing a plurality of packers.

FIG. 3 is an illustration of a packer assembly 10 having a plurality of packers 14. Packer assembly 10 is connected to drillstring 22 to form a wellbore tool 32. Wellbore tool 32 as illustrated is adapted for conducting drillstem testing. Packer assembly 10 includes a slip-joint 16 connected to drillstring 22. A first packer 14 is connected to slip-joint 16. A spacing mandrel 12 is connected between each pair of adjacent packers 14 to define a spacing 20 which provides a testing or isolation zone. Although it is not illustrated, it should be recognized that spacing mandrel 12 may include perforations or slots to provide fluid communication between the exterior of packer assembly 10 and the interior of packer assembly 10. Sensors 24 may be connected along portions of drillstring 22 of wellbore 32.

FIGS. 4 through 8 illustrate various examples of the packer assemblies 10 and wellbore tools 32 having adjustable length spacing mandrels 12. Adjustable length spacing mandrels 12 provide the ability to vary the length of spacing 20 after wellbore tool 32 is positioned in the wellbore.

Figure 4A:
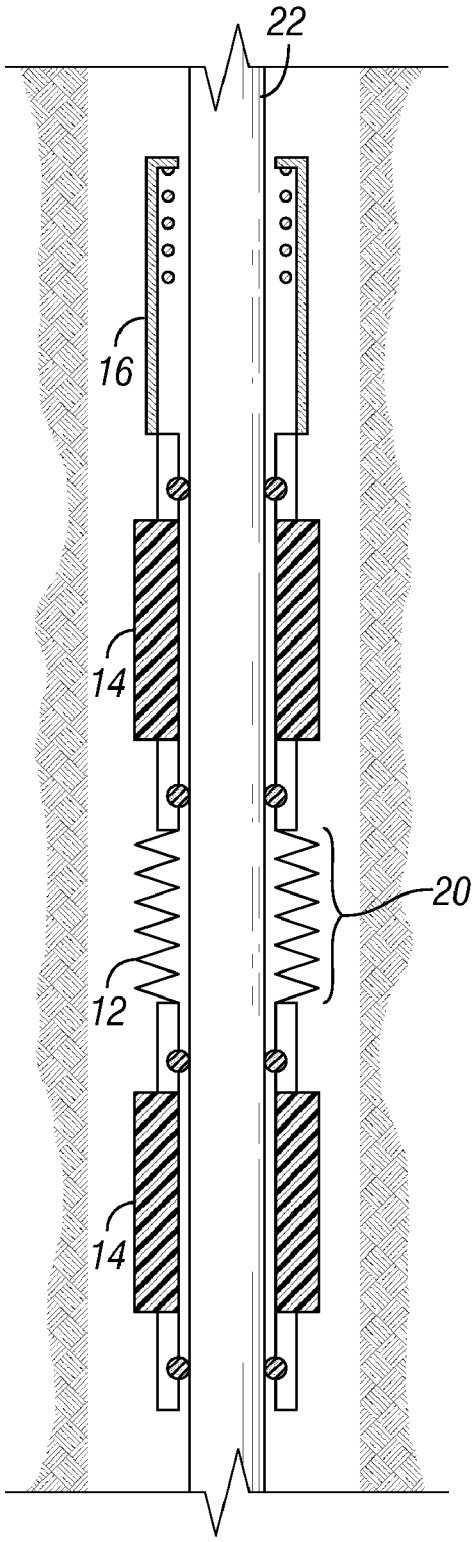
FIGS. 4A-4C illustrate a packer assembly having an adjustable length spacing member comprising a bellows type member.
Figure 4B:
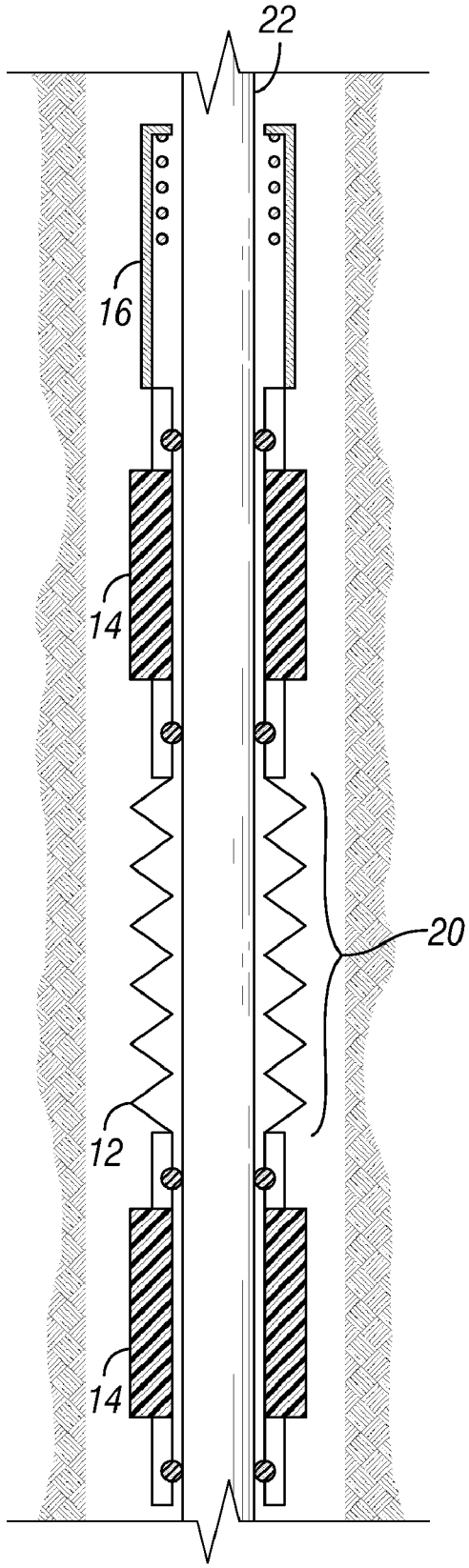
Figure 4C:
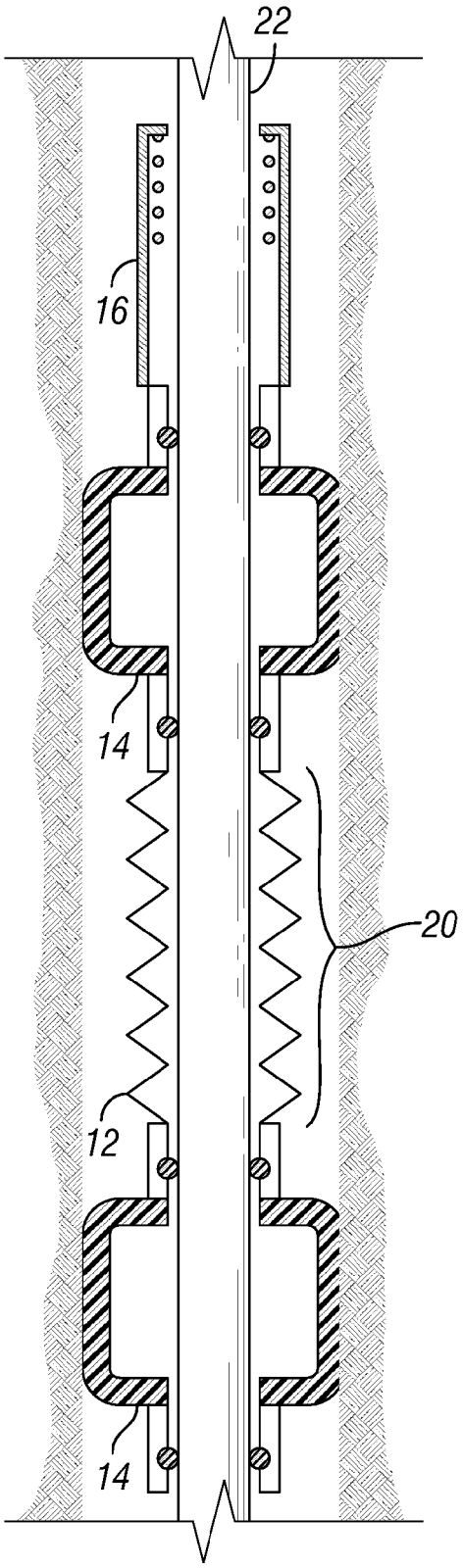

Referring now to FIGS. 4A-4C, spacing mandrel 12 is illustrated as a bellows type member. Adjustable length spacing mandrel 12 is operated by inner fluid injection. Spacing mandrel 12 is shown in a contracted or first position in FIG. 4A. In FIG. 4B, spacing mandrel 12 is shown expanded in length increasing spacing 20 between adjacent pacers 14. FIG. 4C illustrates packers 14 in the expanded position.

Figure 5A:
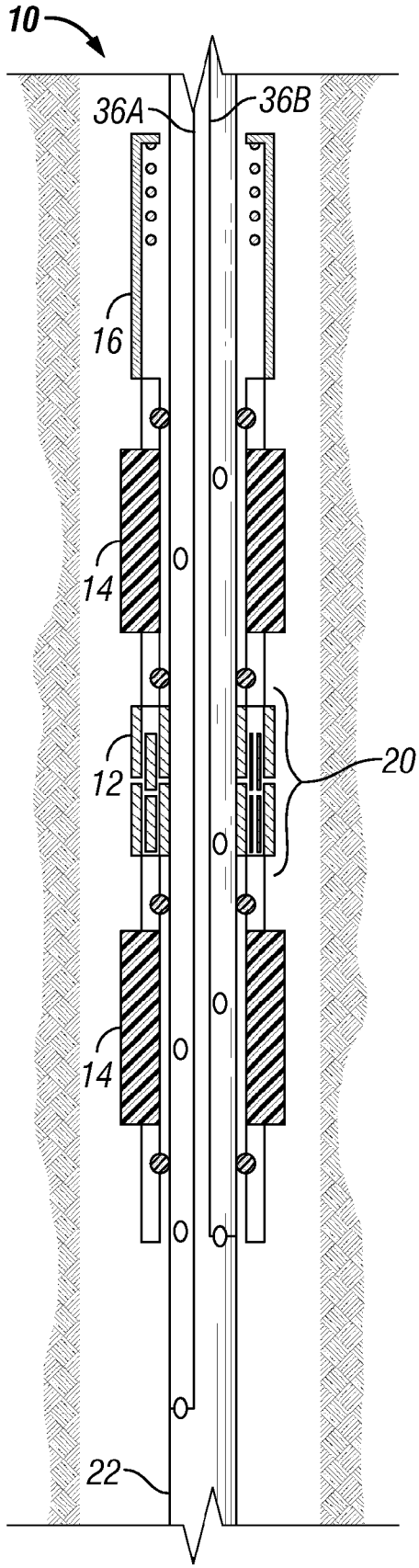
FIGS. 5A-5C illustrate a packer assembly having an adjustable length spacing member comprising a hydraulic piston.
Figure 5B:
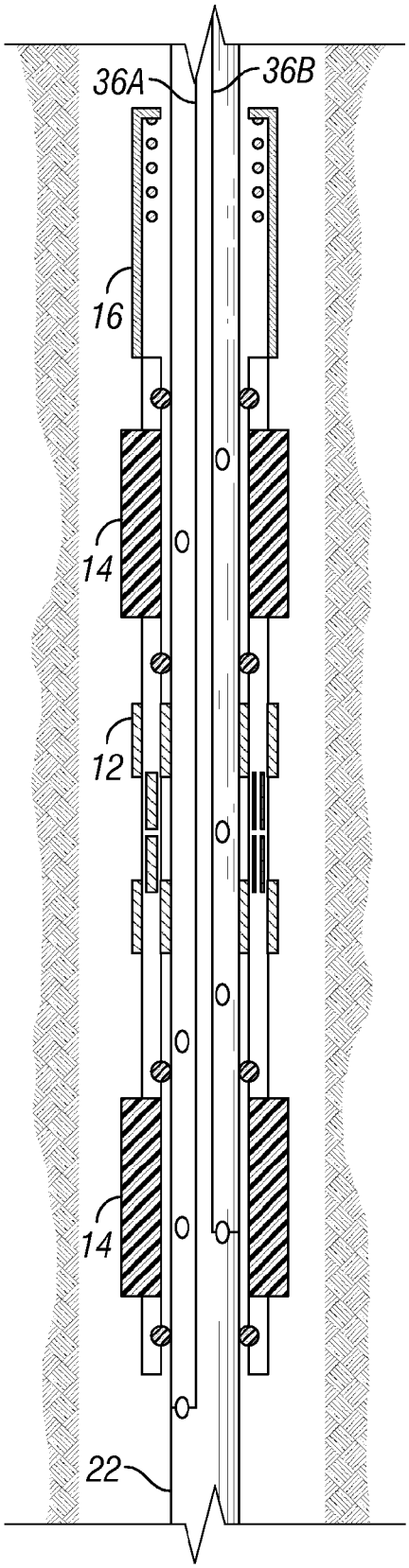
Figure 5C:
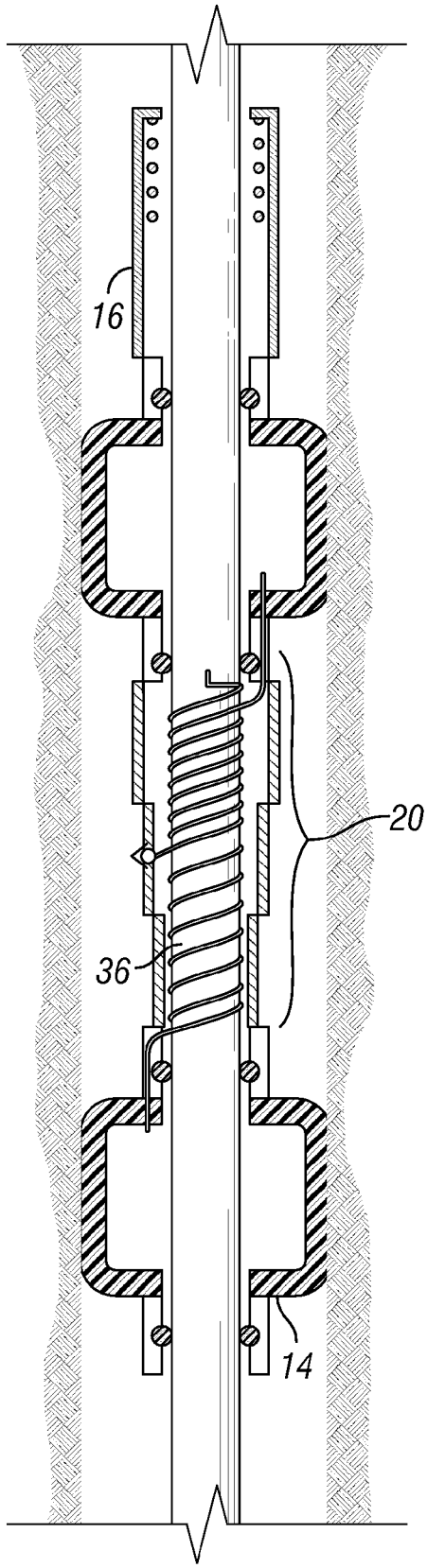

Refer now to FIGS. 5A-5C wherein packer assembly 10 has an adjustable length spacing mandrel 12 comprising a hydraulic piston assembly. Control lines 36, such as hydraulic lines, electric lines, and communication lines may be carried on or through drillstring 22 and/or packer assembly 10. For example, line 36*a* is a hydraulic line passing through drillstring 22 and in operational connection with packers 14 so has to actuate packers 14 from the deflated position (FIG. 5A) to the inflated position (FIG. 5C). A separate pressure line 36*b* may be utilized to operate spacing mandrel 12. In FIG. 5C, a control line 36 is shown in a coiled or spring configuration to facilitate the lengthening of spacer mandrel 12.

Figure 6:
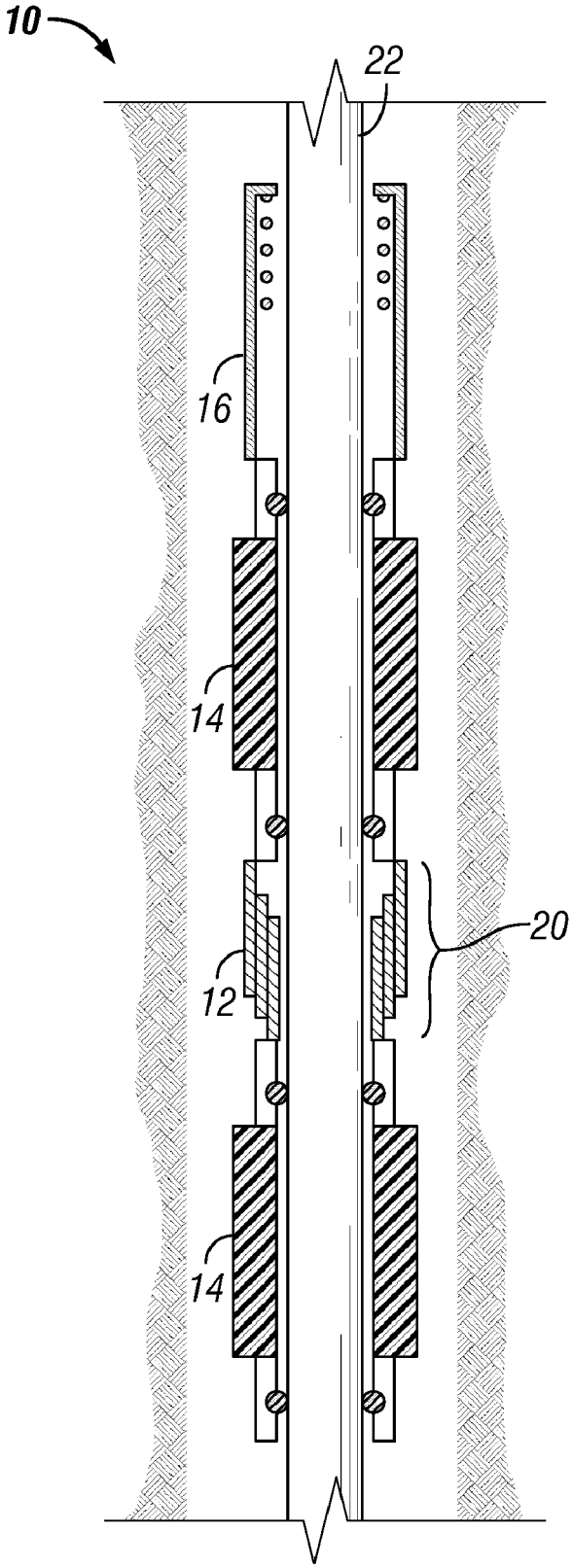
FIG. 6 is a schematic illustration of a packer assembly having a telescopic spacing member.

FIG. 6 is an illustration of a wellbore tool 32 having an adjustable length packer assembly 10. In this example, spacing mandrel 12 comprises a telescopic tubular member. Telescopic member 12 may be powered by various means including hydraulics, electricity and mechanically such as by manipulation of drillstring 22 as shown in FIGS. 7 and 8.

FIGS. 7A-7D illustrate the operation of a wellbore tool 32 of the present invention. Wellbore tool 32 includes a drillstring 22 having a packer assembly 10 connected thereto. Packer assembly 10 includes a slip-joint 16, packers 14, and an adjustable length spacing mandrel 12. While FIGS. 7A-7D generally illustrate operation of a packer assembly 10 of the present invention, the example is directed more specifically to a packer assembly utilizing a telescopic spacing mandrel 12 operated by pipe rotation.

Figure 7A:
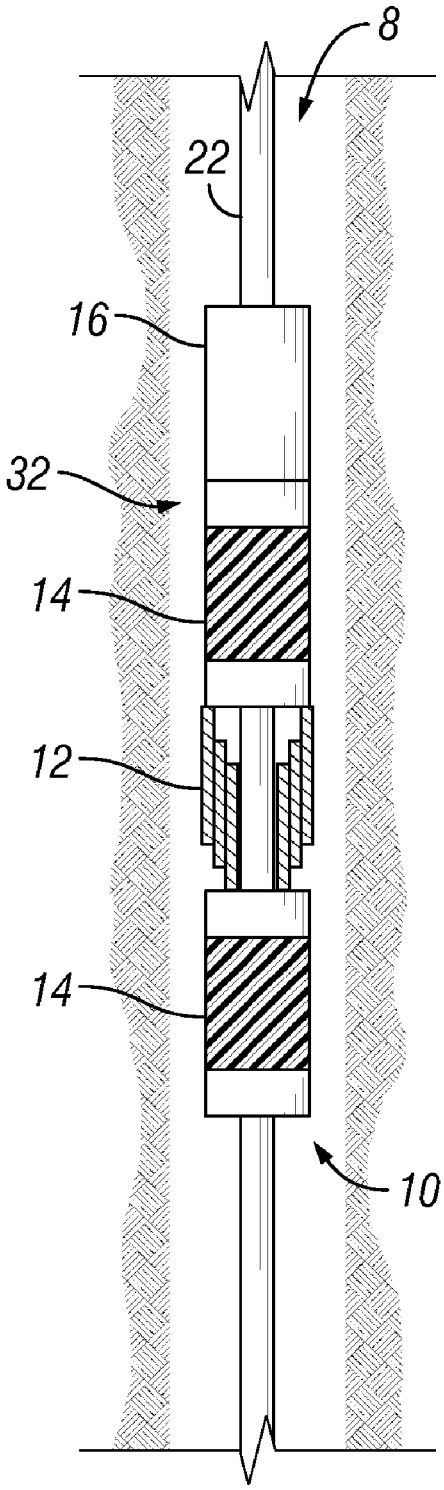
FIGS. 7A-7D illustrate the operation of a wellbore tool of the present invention utilizing axial movement of the drillstring.
Figure 7B:
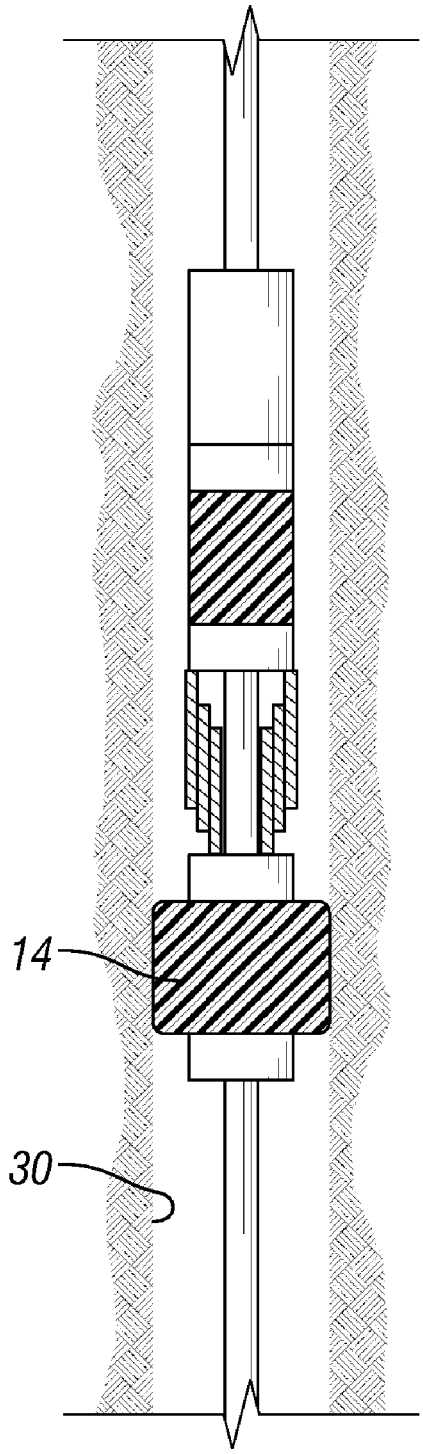
Figure 7C:
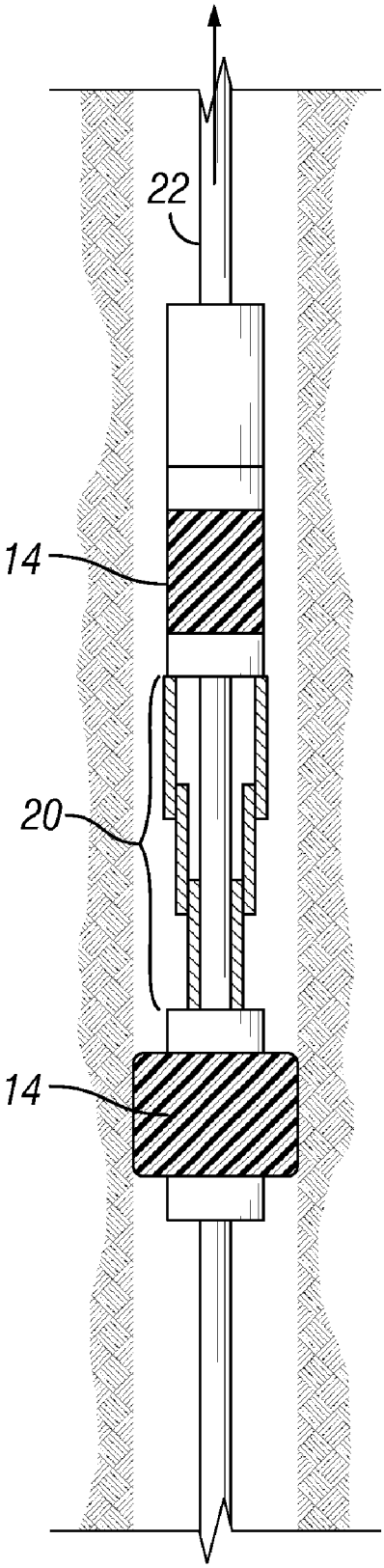
Figure 7D:
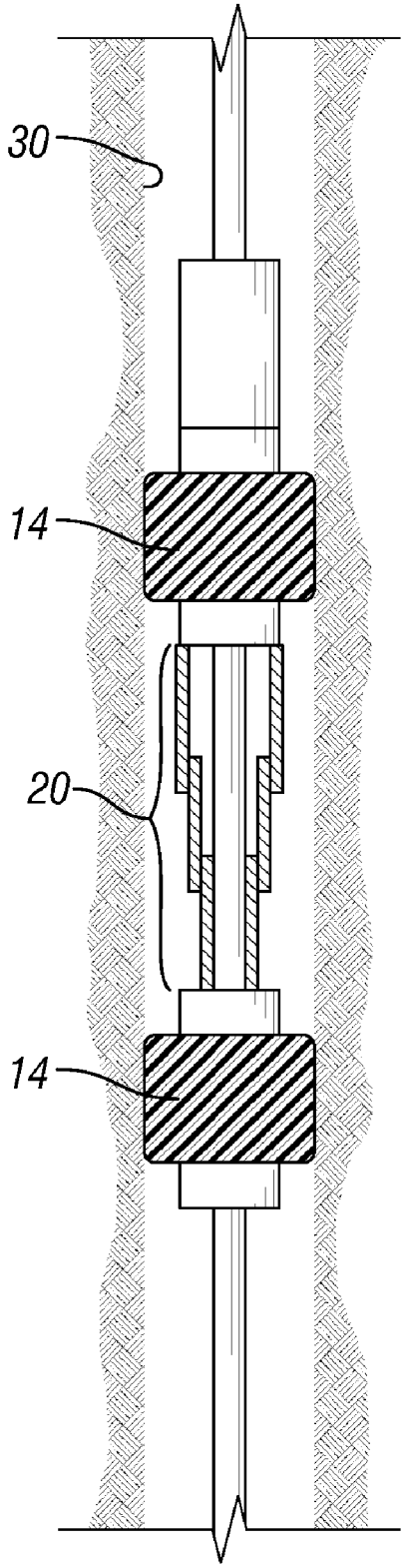

In FIG. 7A, wellbore tool 32 shown in the run-in-hole (RIH) position within wellbore 8. Wellbore tool 32 is positioned at the desired location within wellbore 8. In FIG. 7B, one of the packers 14 is expanded to seal against the wellbore wall 30. Telescopic mandrel 12 is still positioned in it's RIH position, which may be set at a desired length such as a fully retracted position as shown. Then to adjust the spacing 20 between the adjacent packers 14, drillstring 22 is moved. In FIG. 7C, drillstring 22 is moved up, since the lower packer 14 is set and engaged with wall 30, to increase the length of spacing 20. One spacing 20 is extended to the desired length, FIG. 7D, the second packer 14 of the set of packers is set to engage wall 30.

Figure 8A:
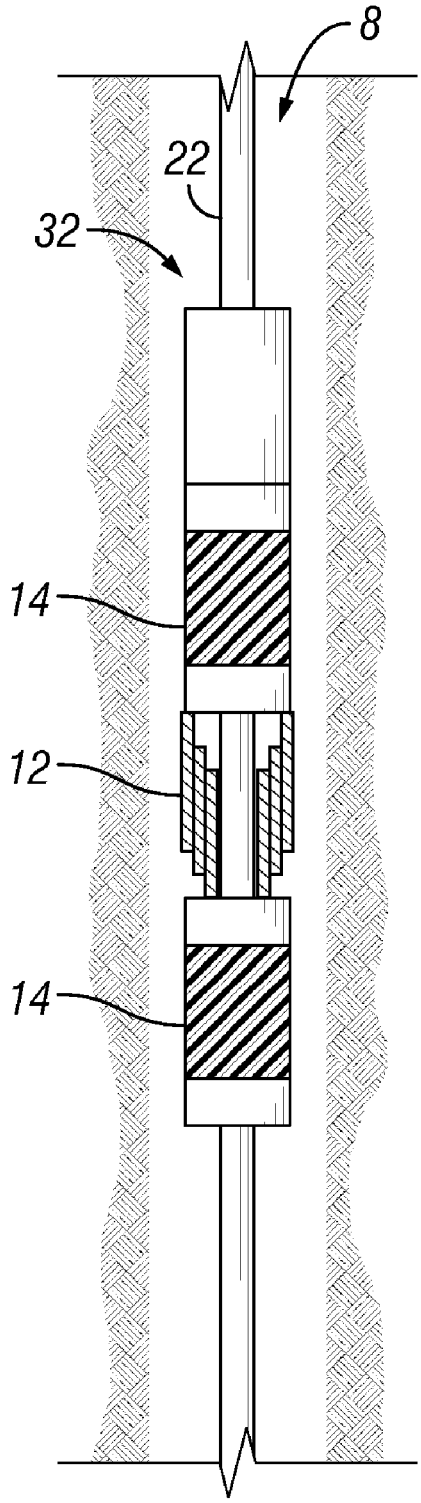
FIGS. 8A-8D illustrate the operation of a wellbore tool of the present invention utilizing rotational movement of the drillstring.
Figure 8B:
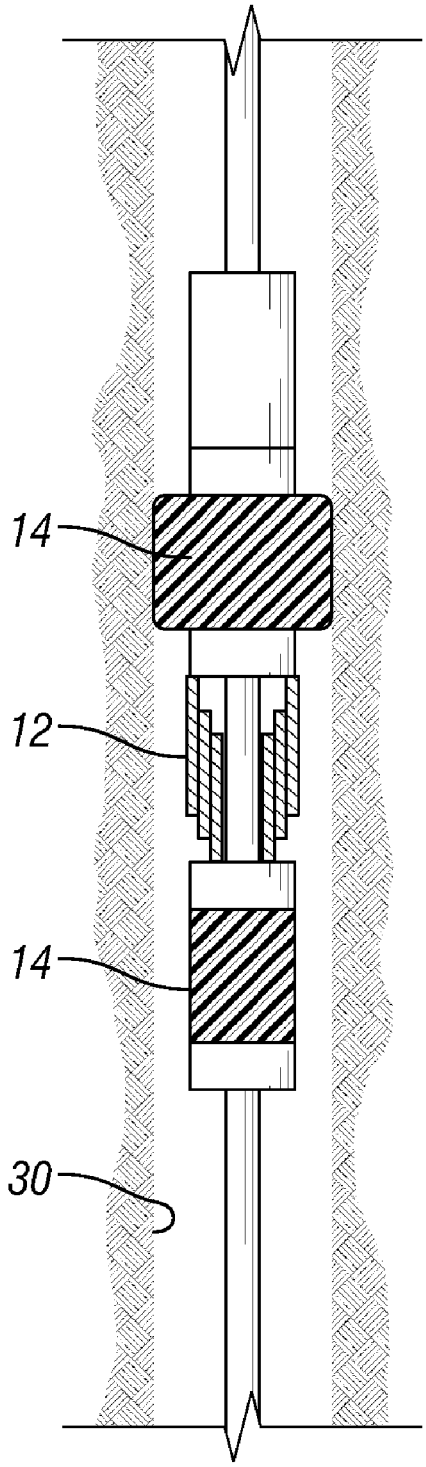
Figure 8C:
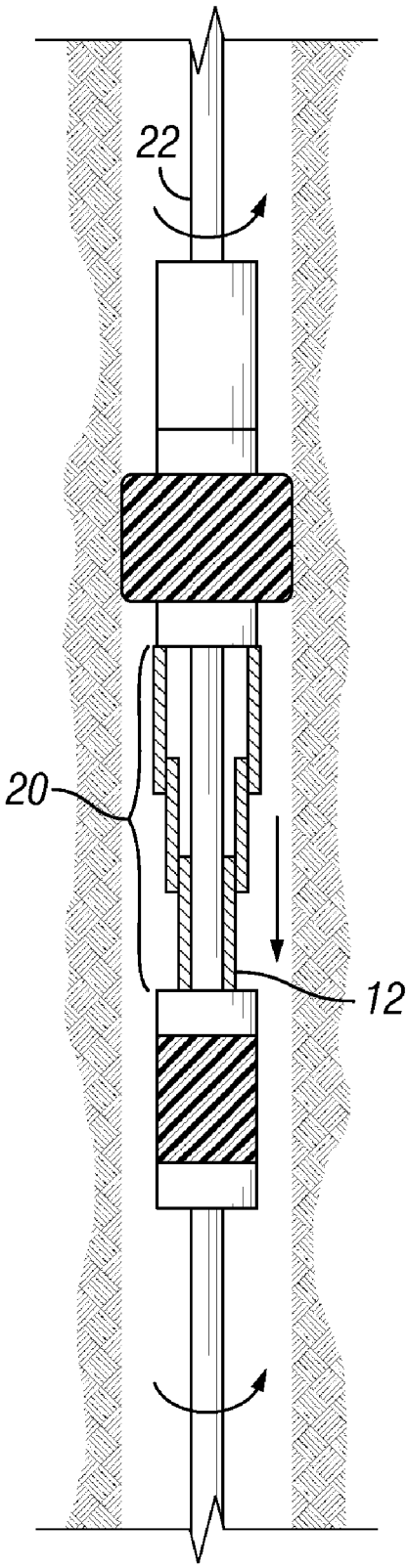
Figure 8D:
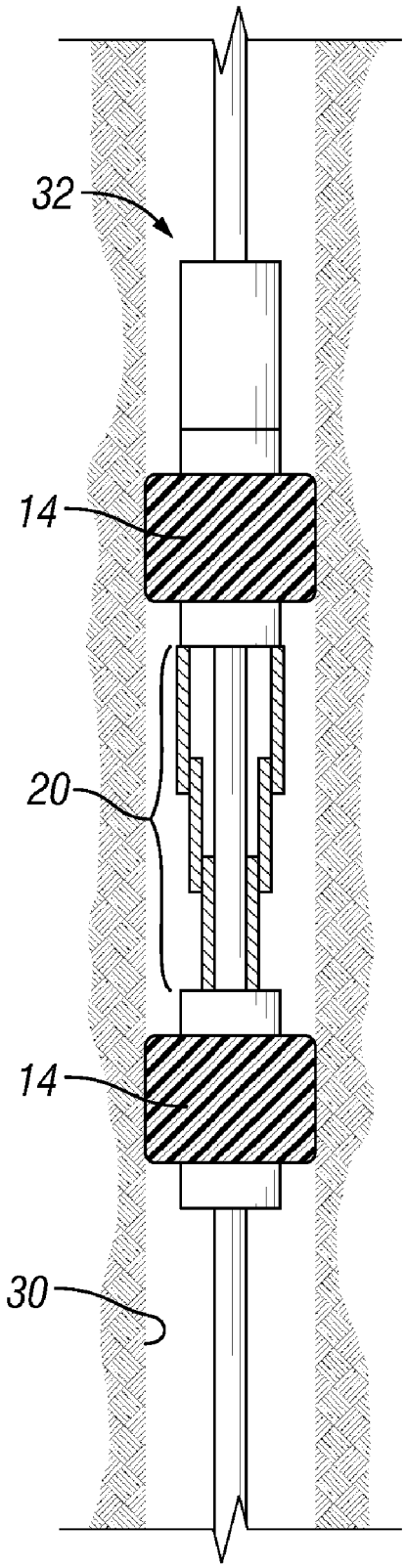

FIGS. 8A-8D illustrate operation of a wellbore tool 32 having a expandable length packer assembly 10 utilizing a thread and nut type of telescopic mandrel 12. In FIG. 8A, wellbore tool 32 is positioned in the desired location within wellbore 8. In FIG. 8B, a first packer 14 of a packer tandem is set to engage wellbore wall 30. In this example the top most packer 14 of the pair of packers is set first. In FIG. 8C, drillstring 22 is rotated to actuate spacing mandrel to expand in length until the desired spacing 20 is achieved. Once the desired spacing 20 is achieved, the second packer 14 is expanded to engaged wall 30.

Referring now to FIGS. 1 through 8, a method of conducting a wellbore operation is provided. A wellbore tool 32 for conducting wellbore testing is provided. Tool 32 comprises a testing tool comprising drillpipe 22 having sensors 24 and a packer assembly 10. Sensors 24 include pressure sensors and sampling chambers. Packer assembly 10 includes a slip-joint 16, at least one pair of inflatable packers 14, and an adjustable length spacing mandrel 12 connected between the packers. Wellbore tool is run into the wellbore and positioned at the desired location for conducting operations. A first packer 14 is actuated set to engage the wellbore wall 30. If necessary, spacing mandrel 12 is actuated to expand or contract in length to obtain the desired spacing 20 between a pair of adjacent packers 14. The second packer 14 is actuated to engage the wellbore wall. Wellbore operations are performed.

From the foregoing detailed description of specific embodiments of the invention, it should be apparent that a packer assembly for use in a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of conducting a wellbore operation, the method comprising the steps of:

connecting an inflatable packer assembly to a tubing to form a wellbore tool, the inflatable packer assembly comprising first and second inflatable packers spaced apart from one another by a spacer member, and a slip joint;

positioning the wellbore tool in a wellbore;

inflating the first packer to fully engage a wall of the wellbore;

actuating the spacer member to adjust an axial distance between the first and second inflatable packers only after the first packer has been expanded to the fully engaged position;

inflating the second inflatable packer to engage the wall of the wellbore after the spacer has been actuated to adjust the axial distance between the first and second inflatable packers; and conducting a wellbore operation, wherein the slip joint compensates for axial movements of the tubing when the packers are expanded to engage the wall of the wellbore.

2. The method of claim 1, wherein the step of actuating the spacer member includes manipulating the tubing.

3. The method of claim 1, wherein the slip joint allows for an axial movement of the tubing relative to the packer assembly.

4. The method of claim 1, wherein the slip joint further allows for a rotational movement of the tubing relative to the packer assembly.

5. The method of claim 1, wherein the slip joint allows for a rotational movement of the tubing relative to the packer assembly.

6. The method of claim 1, wherein the slip joint is configured to allow the tubing to move axially without placing an additional axial load on the first packer when the first packer is engaged with the wellbore wall.

7. The method of claim 1, wherein the slip joint is configured to allow the tubing to move axially by a distance of up to approximately one meter without placing an additional axial load on the first packer when the first packer is engaged with the wellbore wall.

* * * * *